US008900101B2

(12) United States Patent
Stack et al.

(10) Patent No.: US 8,900,101 B2
(45) Date of Patent: Dec. 2, 2014

(54) TREADMILL

(75) Inventors: Anne Stack, St. Albert (CA); Lucien Dnestrianschii, St. Albert (CA); Joseph Marcos, Edmonton (CA); Patricia Dickson, Edmonton (CA)

(73) Assignee: Anne Kathleen Stack, St. Albert (CA)

( * ) Notice: Subject to any disclaimer, the term of this patent is extended or adjusted under 35 U.S.C. 154(b) by 218 days.

(21) Appl. No.: 13/454,948

(22) Filed: Apr. 24, 2012

(65) Prior Publication Data

US 2013/0281263 A1 Oct. 24, 2013

(51) Int. Cl.
*A63B 22/02* (2006.01)
*A01D 15/00* (2006.01)

(52) U.S. Cl.
USPC ..... 482/54; 119/700

(58) Field of Classification Search
USPC ..... 482/54, 51; 119/700, 702; 256/65.14, 256/25
See application file for complete search history.

(56) References Cited

U.S. PATENT DOCUMENTS

| | | | | | |
|---|---|---|---|---|---|
| 2,155,684 | A * | 4/1939 | Richards | 119/700 |
| 4,445,683 | A * | 5/1984 | Ogden | 482/54 |
| 4,635,928 | A * | 1/1987 | Ogden et al. | 482/54 |
| 5,114,390 | A * | 5/1992 | Tribelhorn, Jr. | 482/54 |
| 5,277,150 | A * | 1/1994 | Rhodes | 119/700 |
| D347,912 | S * | 6/1994 | Golden et al. | D30/160 |
| 6,347,603 | B1 * | 2/2002 | Felger | 119/700 |
| 6,837,186 | B1 * | 1/2005 | Terao | 119/700 |
| 6,926,644 | B2 * | 8/2005 | Chen | 482/54 |
| 7,536,977 | B1 * | 5/2009 | Williams | 119/700 |
| 7,654,229 | B2 * | 2/2010 | Smith | 119/700 |
| 8,608,624 | B2 * | 12/2013 | Shabodyash et al. | 482/54 |
| 2002/0005512 | A1 * | 1/2002 | Trill | 256/25 |
| 2012/0252635 | A1 * | 10/2012 | Woelfel et al. | 482/54 |

* cited by examiner

*Primary Examiner* — Loan H Thanh
*Assistant Examiner* — Megan Anderson
(74) *Attorney, Agent, or Firm* — Christensen O'Connor Johnson Kindness PLLC

(57) ABSTRACT

A treadmill has an endless belt and a housing supporting movement of the endless belt along the housing. The housing has a top surface, a bottom surface and a plurality vertical channels extending between the top surface and the bottom surface. Posts are vertically movable in the vertical channels. The posts are secured in a selected position in the vertical channels, with an upper portion of a selected length extending above the top surface and, if desired, a lower portion of a selected length extending below the bottom surface.

11 Claims, 9 Drawing Sheets

TREADMILL

FIELD

There is described a treadmill which was developed for the purpose of exercising animals, primarily dogs. It will be appreciated that the treadmill described could be also used by humans.

BACKGROUND

Treadmills provide a means for getting aerobic exercise, when it is not practical to exercise outdoors. There are a number of companies currently selling treadmills for pets, under such brand names as: Spot On, Dogtread, Petrun, Total Pet Health, Pawws, Fit Fur Life, and Jog-a-Dog. These pet treadmills are becoming popular with pet owners and "doggie day care" facilities.

SUMMARY

There is provided a treadmill which has an endless belt and a housing supporting movement of the endless belt along the housing. The housing has a top surface, a bottom surface and a plurality vertical channels extending between the top surface and the bottom surface. Posts are vertically movable in the vertical channels. The posts are secured in a selected position in the vertical channels, with an upper portion of a selected length extending above the top surface and, if desired, a lower portion of a selected length extending below the bottom surface.

This treadmill was originally developed for working with small dogs. The structure enables the lower portion of all of the posts to extend below the bottom surface of the housing to support the housing at a convenient working height. This enabled personnel to interact with the dogs, without having to bend over. It was subsequently considered that this working height feature might provide advantages when working with children in facilities such as children's hospitals.

The housing for the treadmill has a front end and a back end. The housing was made with the endless belt fixed at an incline with the endless belt being higher at the front end than it is at the back end. This configuration generally followed a configuration common with treadmills used with humans. It was subsequently determined that the needs of the dogs varied. A fat old dog did not require the same workout as a high spirited young dog. This is where the extendible post feature of the treadmill came in handy. The lower portion of only those posts at the back end can be lowered to extend below the bottom surface of the housing to support the housing so that the endless belt is in a horizontal orientation. This enables a fat old dog to exercise on a level surface. The lower portion of only those posts at the front end can be lowered to extend below the bottom surface of the housing to support the housing so that the endless belt is at an inclined orientation that exceeds the incline from the front end to the back end of the housing. This enables a high spirited young dog to be given a more rigorous work out or a workout within in a shorter time period. It will be appreciated that there are also fat old humans and high spirited young humans that can benefit from the same adjustment features. This form of adjustment is relatively low cost as compared to incline adjustment mechanisms present in some of the more expensive human treadmills.

For the safety of the pets, it is preferred that there be some form of containment barrier be provided so the pets do not jump off the moving treadmill. With the treadmill, the upper portion of the posts extending above the top surface support a vertical containment barrier.

There are different engagements that can be used between the posts and the vertical containment barriers. With the engagement that has been chosen for illustration, the posts have longitudinal channels defining a female engagement and opposed peripheral edges of each of the containment barriers define a male engagement.

In order to ensure that there will not be separation between the male engagement and the female engagement in the event that the pet runs into the vertical barrier, the male engagement is bulbous with a narrow supporting neck and the female engagement has a narrow entry neck. The bulbous male engagement passes longitudinally along the female engagement, but cannot be withdrawn radially as the bulbous male engagement does not pass through the narrow entry neck.

It is preferred that the posts be detachable from the housing. When the posts and vertical barrier are detached, the housing has a self supporting stored position standing on end. By placing detachable bases onto the posts, the posts and vertical containment barriers can be used to form an enclosure which is useful in containing the pets.

The endless belt of the treadmill can be manually driven by the movement of the pets, but is preferred that the endless belt be motor driven. As motor driven endless belts are well known with treadmills, the manner of driving the endless belt will not be described in detail.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
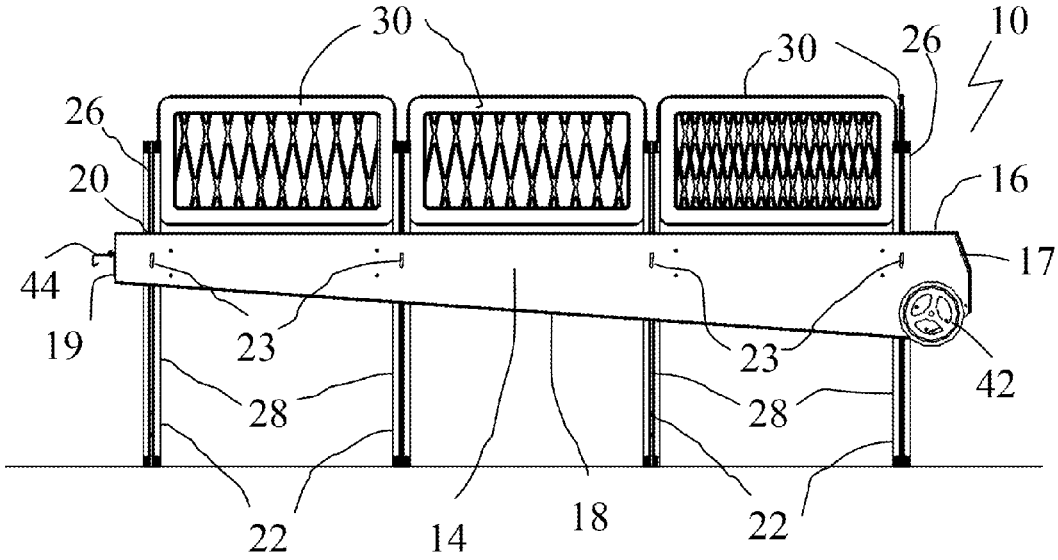
FIG. 1 is a side elevation view of a treadmill raised to a working height.

A treadmill generally identified by reference numeral 10, will now be described with reference to FIGS. 1 through 16.

Figure 4:
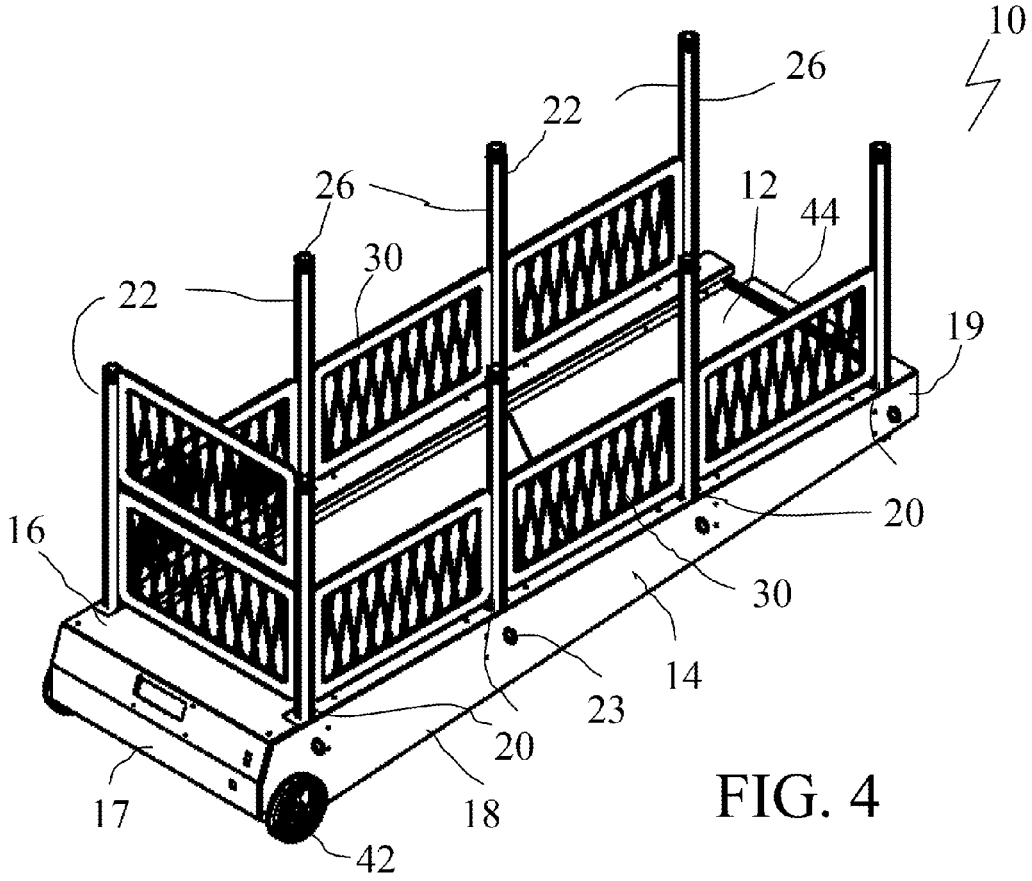
FIG. 4 is a perspective view of the treadmill of FIG. 1.
Figure 5:
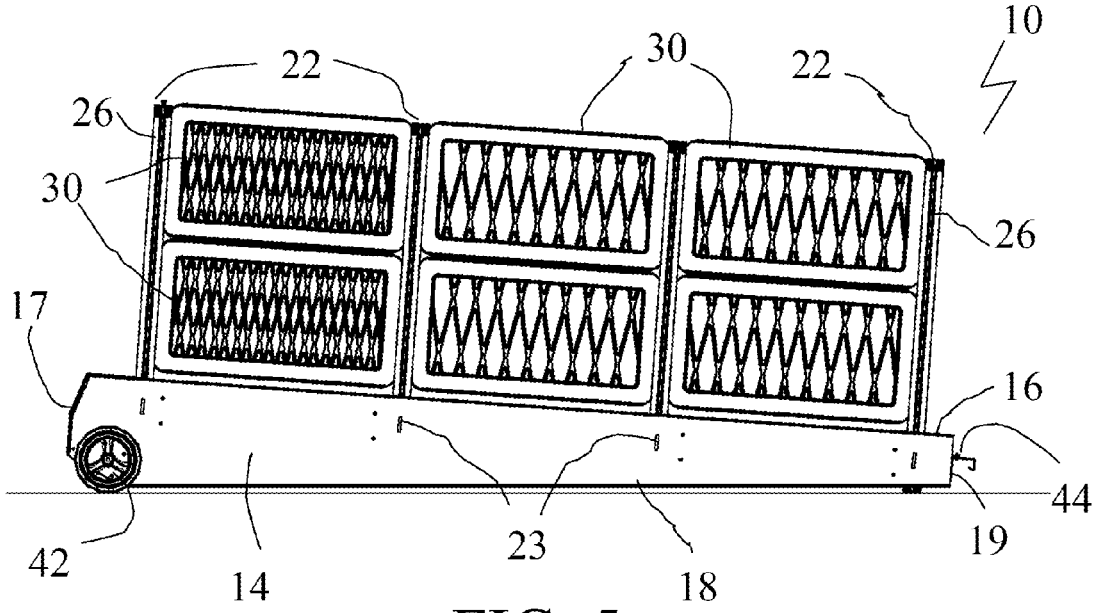
FIG. 5 is a side elevation view of the treadmill of FIG. 1.
Figure 6:
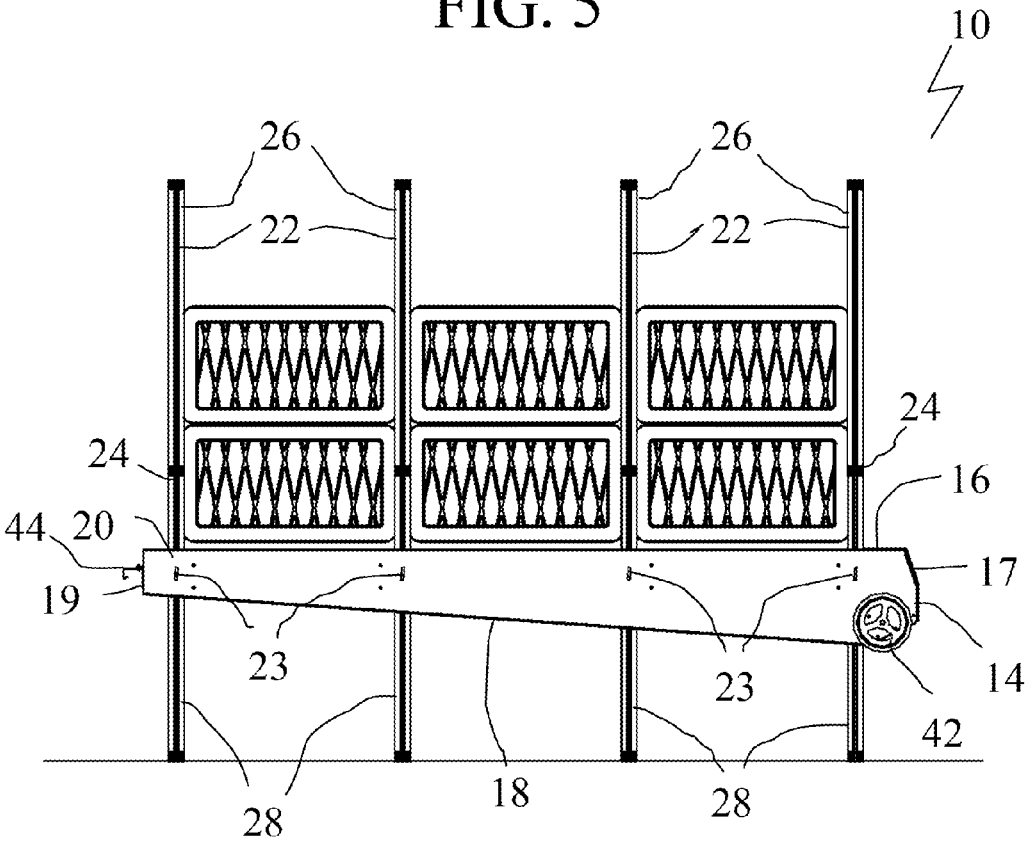
FIG. 6 is a side elevation view of the treadmill of FIG. 1, with vertical barriers of increased height.
Figure 7:
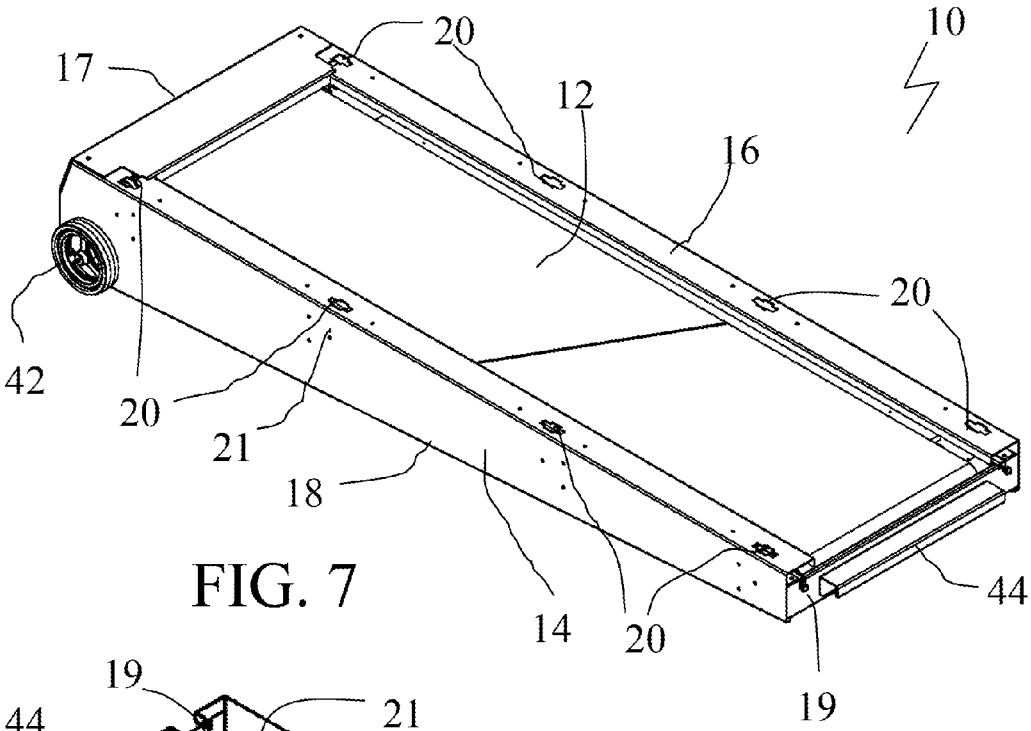
FIG. 7 is a perspective view of the treadmill of FIG. 1, with the vertical barrier removed from the treadmill.
Figure 8:
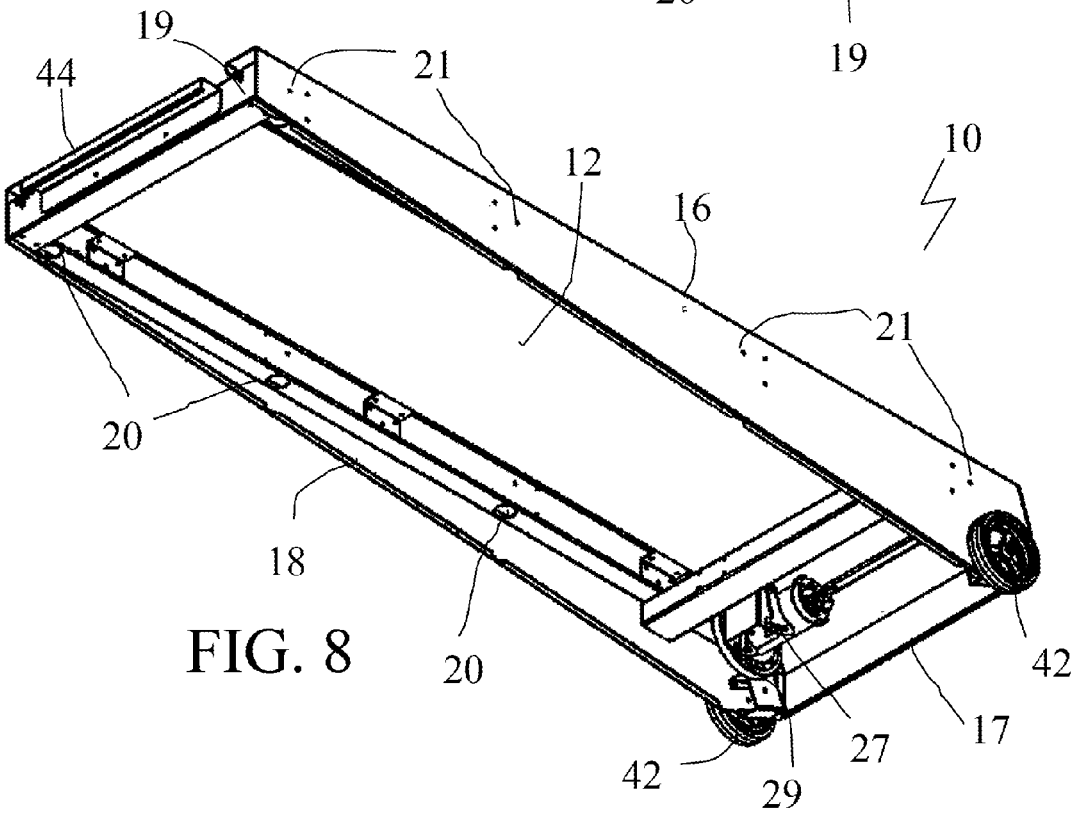
FIG. 8 is an underneath perspective view of the treadmill of FIG. 7.
Figure 16:
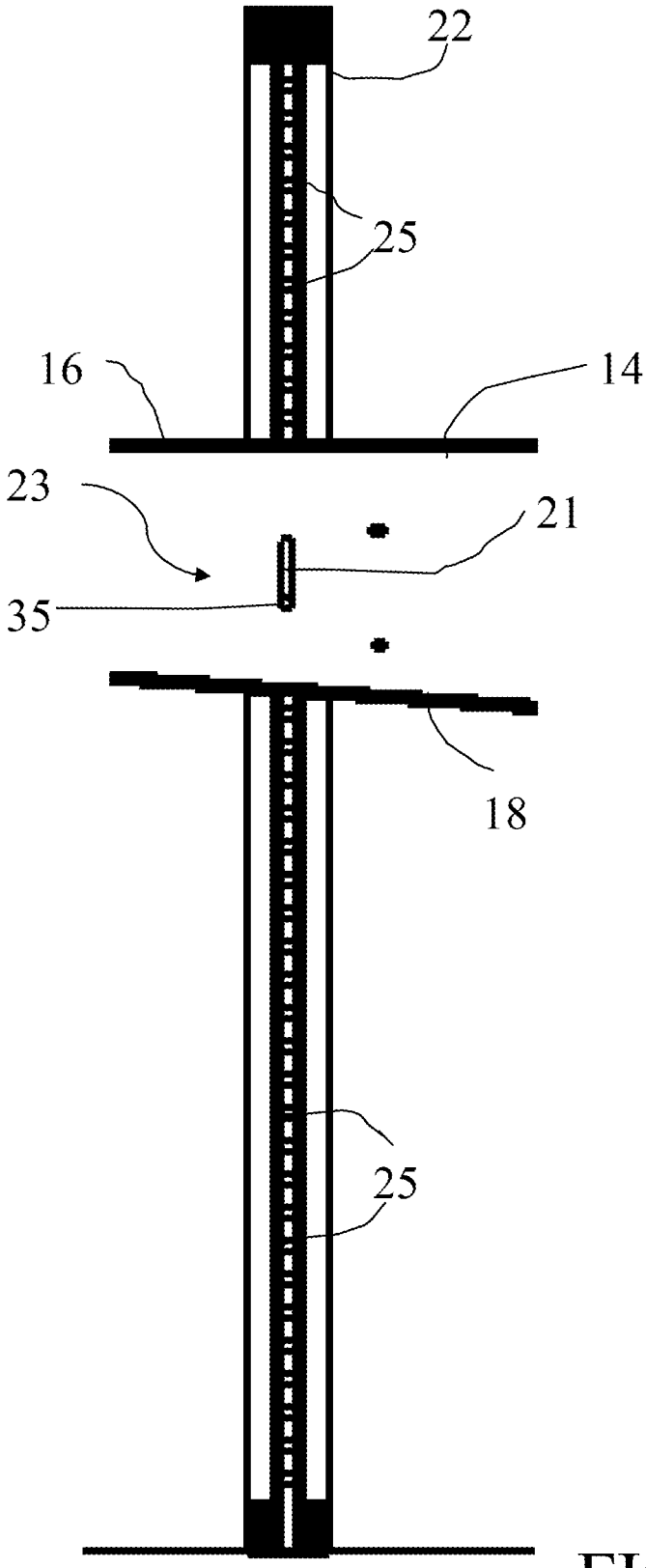
FIG. 16 is a detailed side elevation view of the locking mechanism for the posts.

Structure and Relationship of Parts:

Referring to FIG. 7, a treadmill 10 includes an endless belt 12 and a housing 14 that supports movement of endless belt 12 along housing 14. Referring to FIG. 4, housing 14 has a top surface 16, a bottom surface 18, a front end 17 and a back end 19. Referring to FIGS. 7 and 8, a plurality of vertical channels 20 extend between top surface 16 and bottom surface 18. Referring to FIG. 5, housing 14 supports endless belt 12 at an incline with endless belt 12 being higher at front end 17 than at back end 19. Referring to FIG. 6, posts 22 are positioned in vertical channels 20 and are vertically movable within vertical channels 20. Locking means are provided for securing posts 22 in a selected position in vertical channels 20, such that an upper portion 26 of a selected length of posts 22 extends above top surface 16 and, if desired, a lower portion 28 of a selected length of posts 22 extends below bottom surface 18. In the illustrated embodiment, the locking means is a pin connection identified by reference numeral 23. Referring to FIG. 16, pin connection 23 works by lining up a hole 21 in housing 14 with one of a series of holes 25 within posts 22 and inserting a locking pin 35 through housing 14 into post 22. It will be apparent to one skilled in that art that alternative locking means could be used including a nut and bolt combination, a friction lock or any other type of lock which is able to hold posts 22 at the selected position. Referring to FIG. 8, a motor 27 is provided which rotates a friction wheel 29 that imparts movement to endless belt 12. There are various ways of driving an endless belt with a motor. As this is well known in the art, it will not be further described.

Figure 2:
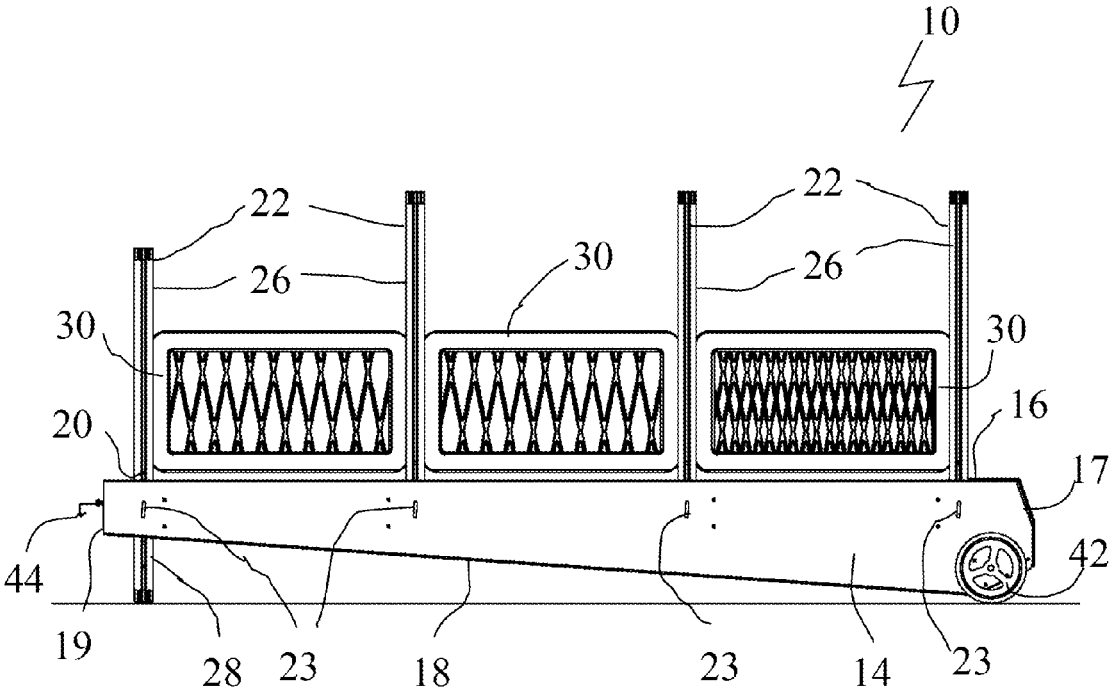
FIG. 2 is a side elevation view of the treadmill of FIG. 1 with only one end raised to level the endless belt.
Figure 3:
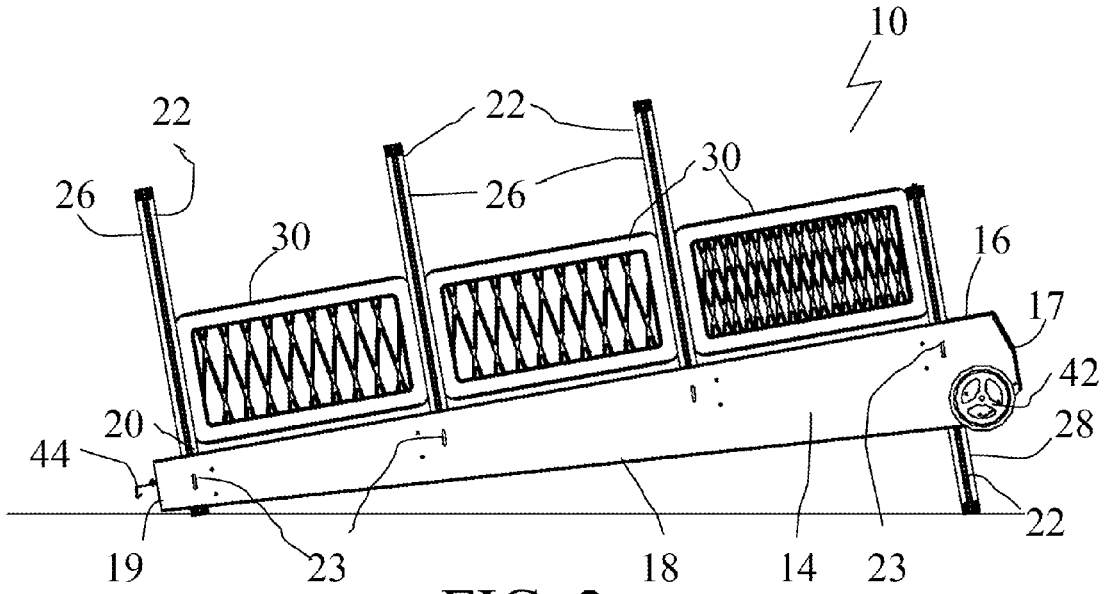
FIG. 3 is a side elevation view of the treadmill of FIG. 1 with only one end raised to increase the angle of incline of the endless belt.

Referring to FIG. 6, posts 22 may be secured with different selected lengths of upper portion 26 extending above top surface 16 and lower portion 28 extending below bottom surface 18 for different purposes. Referring to FIG. 1, for a convenient working height, lower portion 28 of all of posts 22 extends below bottom surface 18 of housing 14 to support housing 14 at a convenient elevated height. Referring to FIG. 2, housing 14 may also be supported by posts 22 in a horizontal orientation when lower portion 28 of only posts 22 at back end 19 are lowered to extend below bottom surface 18 of housing 14. Referring to FIG. 3, it is also possible for lower portion 28 of only those posts 22 at front end 17 to be lowered to extend below bottom surface of housing 14 so that endless belt 12 is at an inclined orientation that exceeds the incline from front end 17 to back end 19 of housing 14.

Referring to FIG. 4, a vertical containment barrier 30 may be supported by upper portion 26 of posts 22 extending above top surface 16 of housing 14. A single row of vertical containment barriers 30 may be supported by posts 22 as shown in the present embodiment. Referring to FIG. 5, multiple rows of containment barriers 30 may be supported by posts 22. This allows for a taller containment barrier 30 to be erected as required. Referring to FIG. 6, in order to facilitate increased height posts are secured in end to end relation using a coupler 24. Coupler 24 may be a separate component, but preferably is integrally formed with posts 22.

Figure 15:
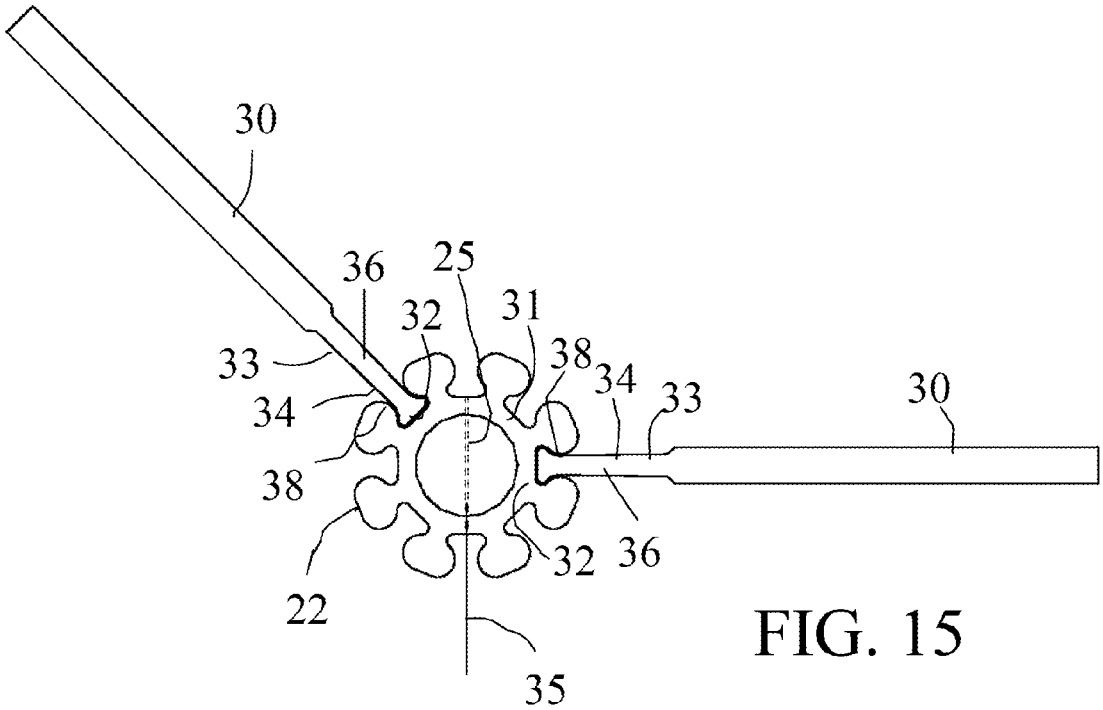
FIG. 15 is a detailed top plan view, partially in section, of mating components of the vertical barrier from the treadmill of FIG. 1.

Referring to FIG. 15, posts 22 have longitudinal channels 31 which define a female engagement 32 and opposed peripheral edges 33 of containment barriers 30 define a male engagement 34. Male engagement 34 is bulbous with a narrow supporting neck 36 and female engagement 32 has a narrow entry neck 38. Bulbous male engagement 34 passes longitudinally along female engagement 32 but cannot be withdrawn radially as bulbous male engagement 34 does not pass through narrow entry neck 38 of female engagement 34.

Figure 10:
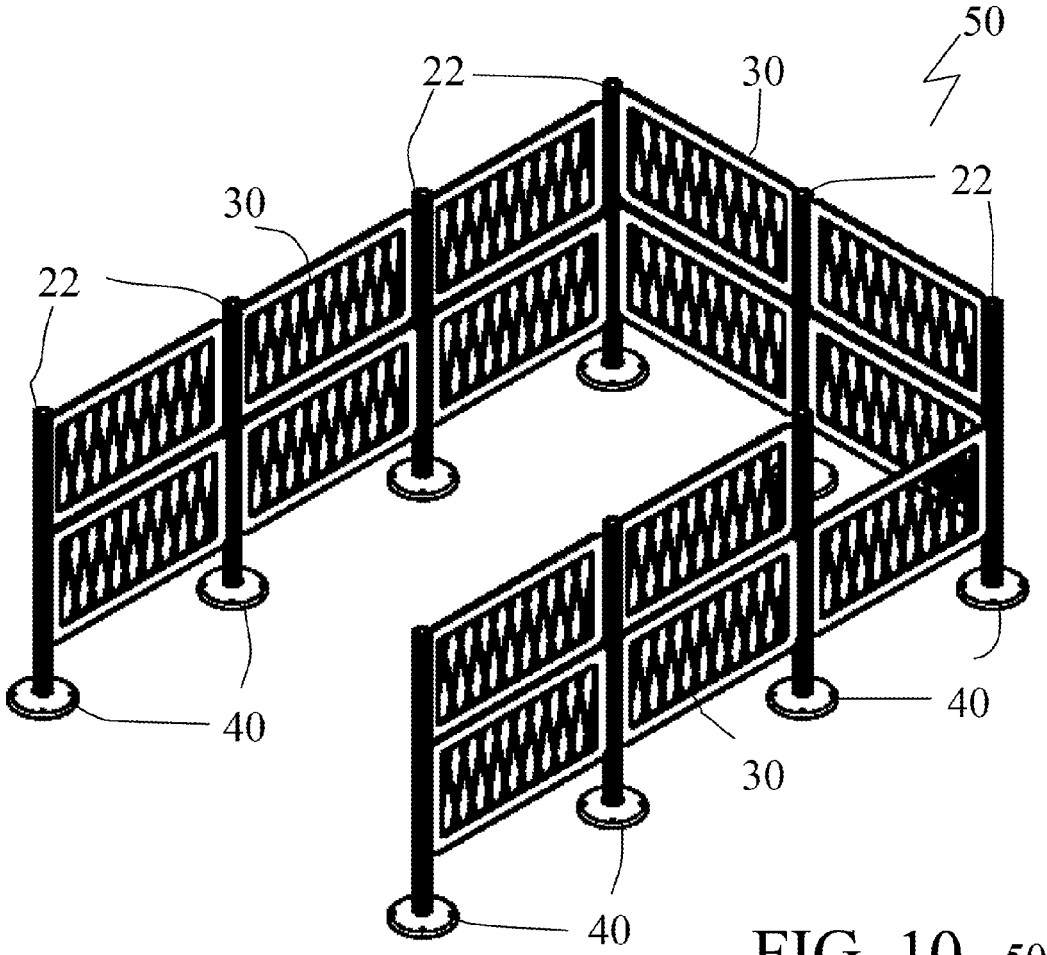
FIG. 10 is a perspective view of the vertical barrier from the treadmill of FIG. 1, with bases attached used as an enclosure.
Figure 11:
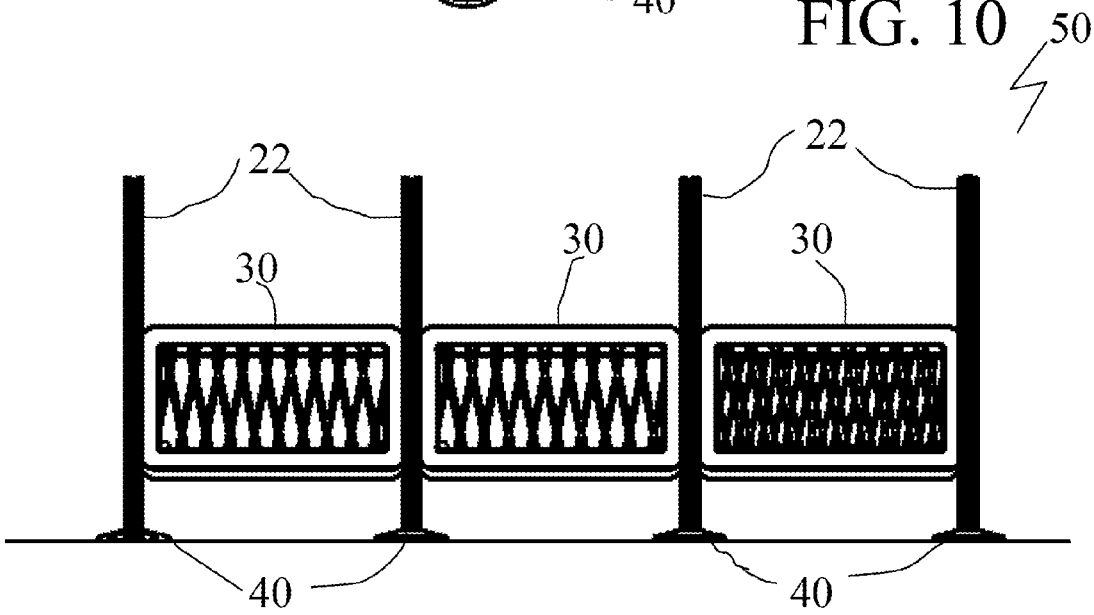
FIG. 11 is a side elevation view of the enclosure of FIG. 10.
Figure 12:
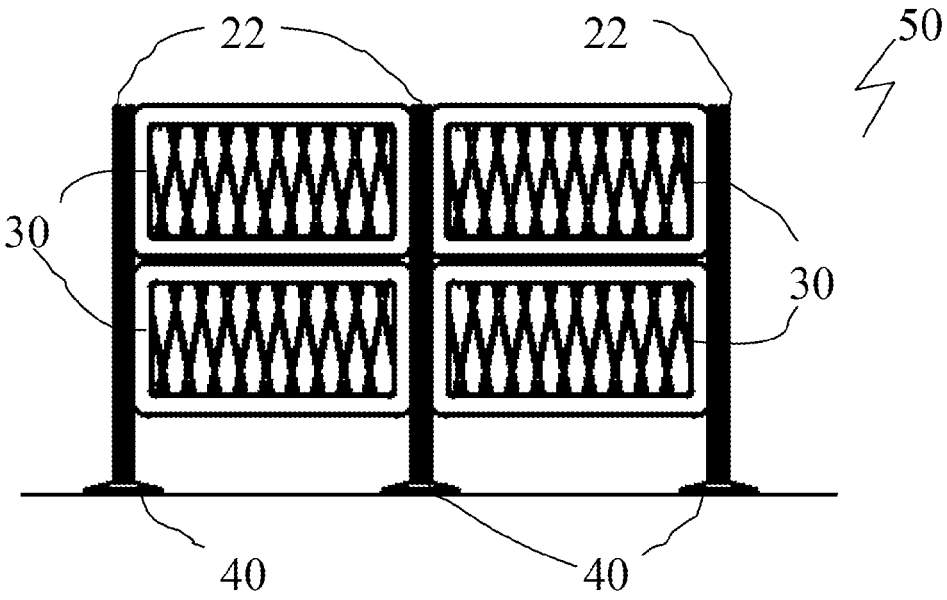
FIG. 12 is an end elevation view of the enclosure of FIG. 10.
Figure 13:
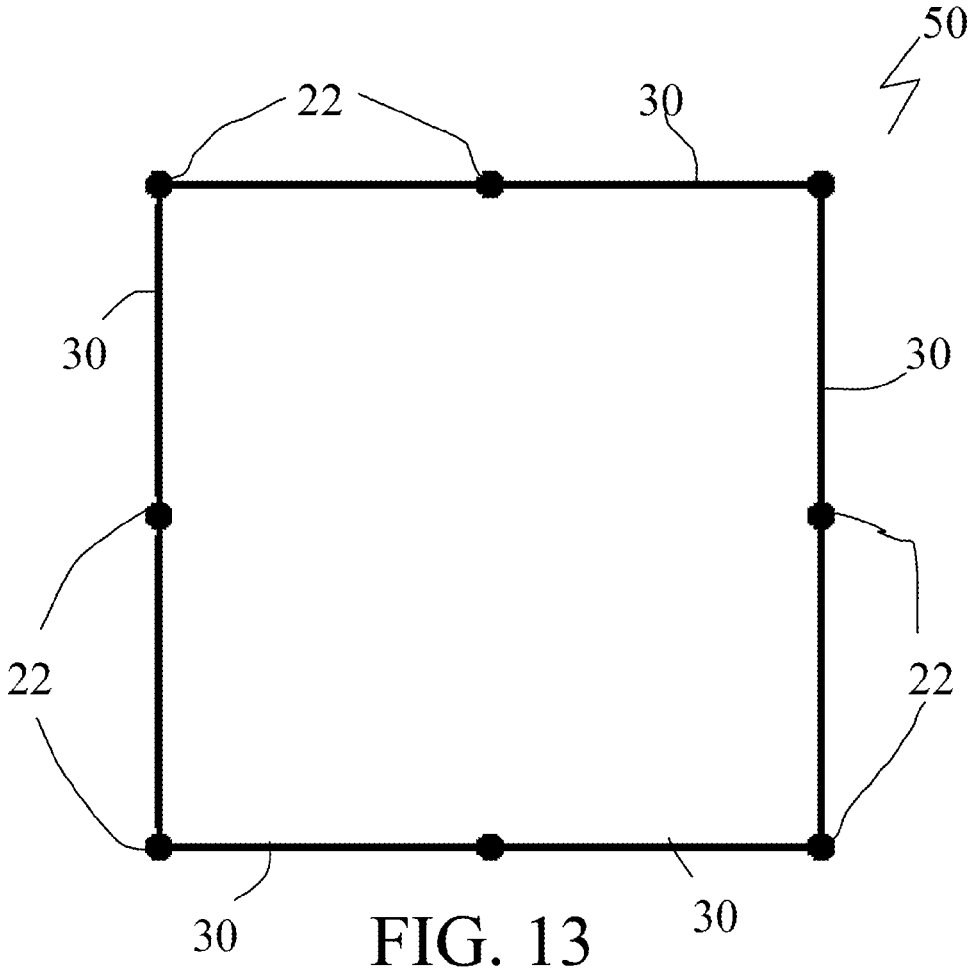
FIG. 13 is a top plan view of a square enclosure.
Figure 14:
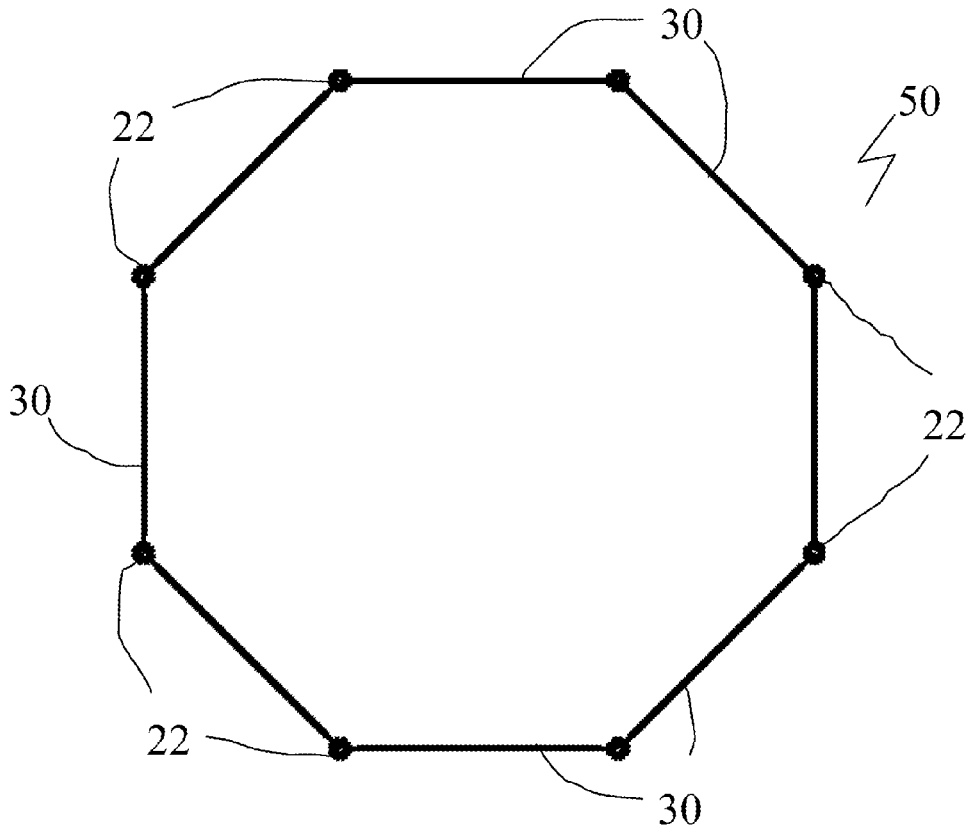
FIG. 14 is a top plan view of a circular enclosure.

Referring to FIGS. 10 through 12, posts 22 may be detachable from housing 14 and have detachable bases 40 which enable posts 22 and vertical containment barriers 30 to form an enclosure 50 separate of treadmill 10. Multiple rows of containment barriers 30 may be utilized to increase the height of enclosure 50 as needed. Referring to FIGS. 13 and 14, enclosure 50 may be any shape such as square or circular. It will be understood that enclosure 50 may be a shape other than what is shown in the present embodiments.

Figure 9:
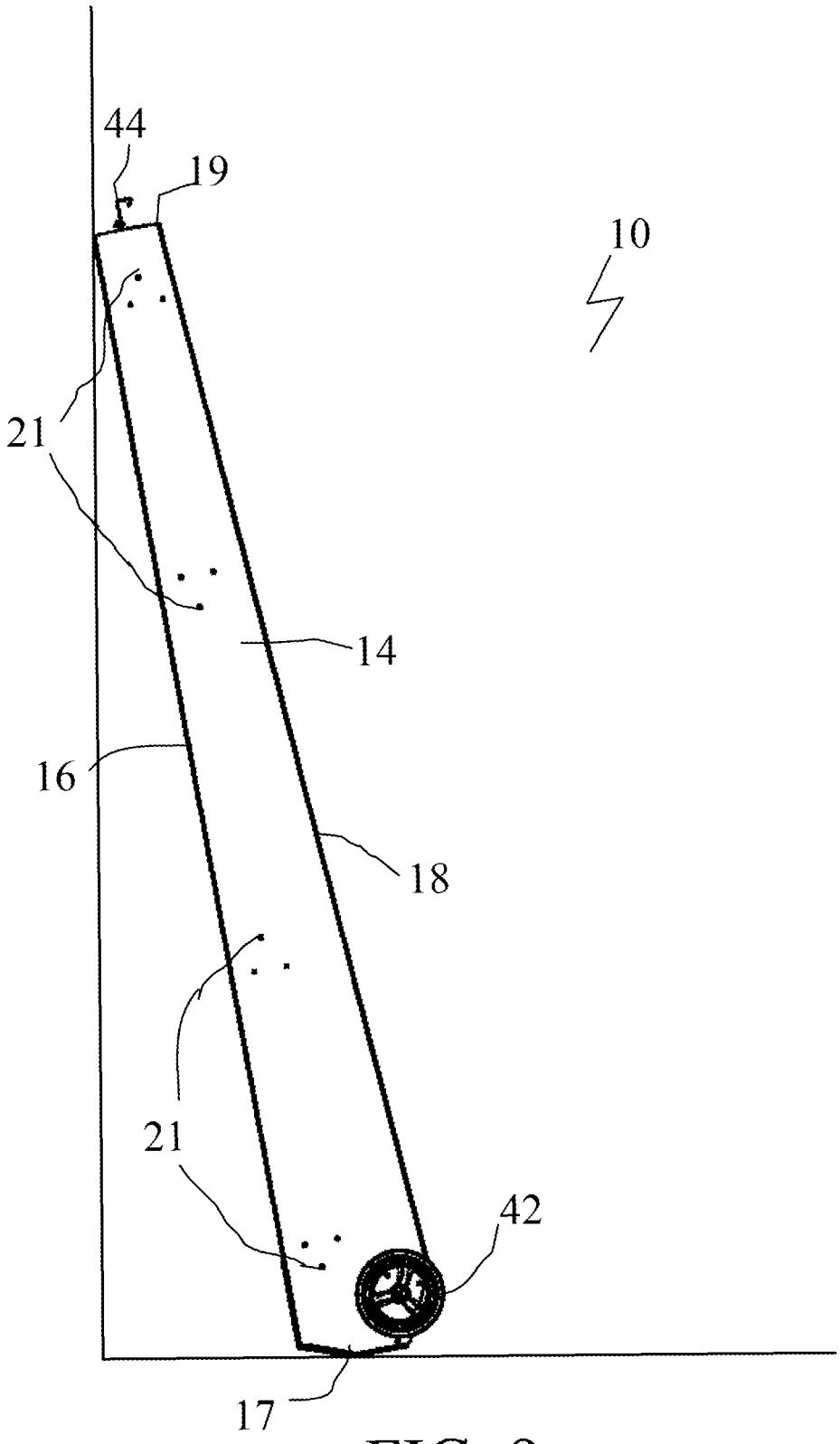
FIG. 9 is a side elevation view of the treadmill of FIG. 7, in a stored position resting on end.

Referring to FIG. 9, housing 14 may also include a set of wheels 42 attached to bottom surface 18 at front end 17 and a handle 44 on back end 19 to allow for movement of treadmill 10 to different locations or in and out of a stored position. Housing 14 is self supporting in a stored position standing front end 17.

Operation:

Referring to FIG. 7, treadmill 10 may be wheeled into an appropriate area by grasping handle 44 and tilting treadmill 10 slightly such that only wheels 42 contact the ground. Housing 14 of treadmill is then laid to rest on the ground such that bottom surface 18 contacts the ground. Referring to FIG. 5, when bottom surface 18 contacts the ground, top surface 16 rests at an angle inclining from back end 19 towards front end 17. Treadmill 10 may be used at ground level and containment barriers 30 may be slid onto upper portion 26 of posts 22 that extend above top surface 16 of housing 14. Referring to FIG. 8, motor 27 imparts movement to endless belt 12.

Referring to FIG. 1, to raise treadmill 10 to a raised working height, lower portion 28 of posts 22 are extended below bottom surface 18 of housing 14. Referring to FIG. 6, all of posts 22 may be lowered and locked into position by locking pin 23. This lifts housing 14 away from the ground with treadmill 10 supported at a convenient working height by posts 22. This feature may be used when working with a number of small dogs. To provide security against the dogs jumping off treadmill 10 while treadmill 10 is in use, vertical containment barriers 30 are slid onto posts 22. Additional posts 22 may be secured in end to end relation using couplers 24 to allow room for additional rows of containment barriers 30 to be added. The additional height may be necessary with larger dogs.

Referring to FIGS. 2 and 3, different orientations of housing 14 may be created by extending lower portion 28 of posts 22 in different manners. Referring to FIG. 2, a horizontal orientation may be created by lowering lower portion 28 of posts 22 at back end 19 below bottom surface 18 of housing 14. This feature may be used if an incline is considered unnecessary or harmful, when exercising old or fat dogs. Referring to FIG. 3, a greater incline may be created by lowering lower portion 28 of posts 22 at front end 17 below bottom surface 18 of housing 14. This feature may be used when exercising a younger dog that needs a more strenuous work out than the normal incline is capable of providing.

Referring to FIG. 9, when not in use, housing 14 may be wheeled on wheels 42 attached to bottom surface 18 at front end 17 to a storing location. Housing 14 is self supporting in a stored position standing front end 17.

Referring to FIG. 10 through 14, when treadmill 10 is not in use, posts 22 may be removed and a combination of containment barriers 30 and posts 22 may be used to create enclosures 50. Referring to FIG. 11, posts 22 stand upright in detachable bases 40. Containment barriers 30 may be slid into place between posts 22. Referring to FIGS. 10 through 12, additional rows of containment barriers 30 may be used to create taller enclosures. Referring to FIGS. 13 and 14, different shaped enclosures may be made based upon the number of posts 22 and containment barriers 30 used.

Referring to FIG. 15, posts 22 and containment barriers 30 are connected together by sliding bulbous male engagement 34 on containment barrier 30 down longitudinal channels 31 which define a female engagement 32 on posts 22. Male engagement 34 has a narrow supporting neck 36 that fits into narrow entry neck 38 of female engagement 34. Male engagement cannot be withdrawn radially as bulbous male engagement 34 does not pass through narrow entry neck 38 of female engagement 34.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A treadmill comprising:

an endless belt;

a housing supporting movement of the endless belt along the housing, the housing having a top surface, a bottom surface and a plurality of vertical channels extending between the top surface and the bottom surface;

posts vertically movable in the vertical channels;

a lock for securing the posts in a selected position in the vertical channels, with an upper portion of a selected length extending above the top surface and, if desired, a lower portion of a selected length extending below the bottom surface;

the upper portion of the posts extending above the top surface support a vertical containment barrier; and each of the posts have longitudinal channels defining a female engagement and opposed peripheral edges of each of the containment barriers define a male engagement.

2. The treadmill of claim 1, wherein the lower portion of all of the posts extend below the bottom surface of the housing to support the housing at a convenient working height.

3. The treadmill of claim 1, wherein the lower portion of only those posts at one end of the housing extend below the bottom surface to support the housing in an inclined orientation.

4. The treadmill of claim 1, wherein the housing has a front end and a back end, the housing supporting the endless belt at an incline with the endless belt being higher at the front end than it is at the back end.

5. The treadmill of claim 4, wherein the lower portion of only those posts at the back end are lowered to extend below the bottom surface of the housing to support the housing so that the endless belt is in a horizontal orientation.

6. The treadmill of claim 4, wherein the lower portion of only the posts at the front end are lowered to extend below the bottom surface of the housing to support the housing so that the endless belt is at an inclined orientation that exceeds the incline from the front end to the back end of the housing.

7. The treadmill of claim 1, wherein the male engagement is bulbous with a narrow supporting neck and the female engagement has a narrow entry neck, such that the bulbous male engagement passes longitudinally along the female engagement, but cannot be withdrawn radially as the bulbous male engagement does not pass through the narrow entry neck.

8. The treadmill of claim 1, wherein the posts are detachable from the housing.

9. The treadmill of claim 8, wherein the posts have detachable bases which enable the posts and vertical containment barriers to form an enclosure.

10. The treadmill of claim 1, wherein the housing is self supporting in a stored position standing on end.

11. The treadmill of claim 1, wherein a motor is provided which rotates a friction wheel that imparts movement to the endless belt.

* * * * *